US011248762B2

(12) United States Patent
Ocegueda Gallaga et al.

(10) Patent No.: US 11,248,762 B2
(45) Date of Patent: Feb. 15, 2022

(54) MULTI-CHANNEL FLAME SIMULATION METHOD AND APPARATUS

(71) Applicant: Polygroup Macau Limited (BVI), Tortola (VG)

(72) Inventors: Victor Hugo Ocegueda Gallaga, Baja California (MX); An-Wu Tang, Guangdong (CN); Lewis Ka Hang Cheng, Hong Kong (CN)

(73) Assignee: Polygroup Macau Limited

( * ) Notice: Subject to any disclaimer, the term of this patent is extended or adjusted under 35 U.S.C. 154(b) by 0 days.

(21) Appl. No.: 16/919,217

(22) Filed: Jul. 2, 2020

(65) Prior Publication Data

US 2020/0332976 A1 Oct. 22, 2020

Related U.S. Application Data

(63) Continuation of application No. 15/825,450, filed on Nov. 29, 2017, now Pat. No. 10,711,963.

(60) Provisional application No. 62/430,504, filed on Dec. 6, 2016.

(51) Int. Cl.

| | |
|---|---|
| ***F21S 10/04*** | (2006.01) |
| ***F21S 6/00*** | (2006.01) |
| ***F21K 9/238*** | (2016.01) |
| ***H05B 45/10*** | (2020.01) |
| *F21Y 113/10* | (2016.01) |
| *F21V 17/02* | (2006.01) |

(52) U.S. Cl.

CPC ..... *F21S 10/043* (2013.01); *F21K 9/238* (2016.08); *F21S 6/001* (2013.01); *H05B 45/10* (2020.01); *F21V 17/02* (2013.01); *F21Y 2113/10* (2016.08)

(58) Field of Classification Search

CPC ..... F21S 10/043; F21S 6/001; F21K 9/238; H05B 45/10; F21Y 2113/10; F21V 17/02

USPC ..... 362/257

See application file for complete search history.

(56) References Cited

U.S. PATENT DOCUMENTS

| | | | |
|---|---|---|---|
| 3,789,211 | A | 1/1974 | Kramer |
| 4,492,896 | A | 1/1985 | Jullien |
| 4,510,556 | A | 4/1985 | Johnson |
| 4,593,232 | A | 6/1986 | McEdwards |
| 5,924,784 | A | 7/1999 | Chliwnyj et al. |
| RE37,168 | E | 5/2001 | St. Louis |

(Continued)

*Primary Examiner* — Michael G Lee
*Assistant Examiner* — David Tardif
(74) *Attorney, Agent, or Firm* — Finnegan, Henderson, Farabow, Garrett & Dunner LLP

(57) ABSTRACT

A flame simulation method including: identifying, by a computing device, a maximum brightness level value and a primary event generation level; setting, in response to determining that a first event occurred based on the primary event generation level, a secondary event generation level; adjusting the secondary event generation level towards a baseline secondary event generation level; adjusting a current brightness value of a lighting element of a flame simulation apparatus towards the maximum brightness level value; setting, in response to determining that a second event occurred based on the secondary event generation level, the current brightness level value of the lighting element to a value less than the maximum brightness level; and controlling, by the computing device, a brightness level of the lighting element to correspond to the current brightness level value of the lighting element.

19 Claims, 9 Drawing Sheets

(56) References Cited

U.S. PATENT DOCUMENTS

| | | | | |
|---|---|---|---|---|
| 6,719,443 | B2 | 4/2004 | Gutstein et al. | |
| 7,125,142 | B2 | 10/2006 | Wainwright | |
| 7,327,337 | B2 | 2/2008 | Callahan | |
| 7,332,878 | B1 | 2/2008 | Smith | |
| 7,605,809 | B2 | 10/2009 | Wey et al. | |
| 8,256,935 | B1 * | 9/2012 | Cullimore | F21S 6/001 362/392 |
| 8,550,660 | B2 | 10/2013 | Patton et al. | |
| 8,562,186 | B2 | 10/2013 | Gutstein et al. | |
| 9,068,706 | B2 | 6/2015 | Fournier et al. | |
| 2004/0233681 | A1 * | 11/2004 | Yao | F21S 9/02 362/565 |
| 2005/0196716 | A1 | 9/2005 | Haab et al. | |
| 2007/0002560 | A1 | 1/2007 | Gutstein et al. | |
| 2008/0129226 | A1 | 6/2008 | DeWitt et al. | |
| 2015/0354769 | A1 | 12/2015 | Patton et al. | |
| 2017/0159900 | A1 | 6/2017 | Gerson et al. | |
| 2018/0020524 | A1 * | 1/2018 | Tylicki | G02B 6/001 |

* cited by examiner

600(a)

600(b)

600(c)

600(d)

600(e)

600(f)

700(a)

700(b)

700(c)

700(d)

800(a)

800(b)

800(c)

800(d)

MULTI-CHANNEL FLAME SIMULATION METHOD AND APPARATUS

CROSS-REFERENCE TO RELATED APPLICATION

This application is a continuation of U.S. Non-Provisional application Ser. No. 15/825,450, filed on 29 Nov. 2017, which claims priority to and the benefit under 35 U.S.C. § 119(e) of U.S. Provisional Patent Application Ser. No. 62/430,504, filed on 6 Dec. 2016, the contents of which are hereby incorporated by reference in their entirety fully set forth below.

TECHNICAL FIELD

Aspects of the present disclosure relate to lighting instrumentality and, more particularly, to flame mimicry through the use of multi-channel light sources.

BACKGROUND

A candle or other flame-based light source is often desirable for aesthetic purposes but may create a fire risk and otherwise cause harm or annoyance through the creation of smoke, heat, and residue. In the related art, efforts have been made to simulate a flickering effect by applying a simple random-loop-based algorithm to a single lighting element or an entire array of lighting elements, or by directing light onto a movable flame stand-in, such as a flame sheet. But in the related art, the flickering effect is often too artificial, non-realistic, and may cause annoyance. Therefore, what is needed is an alternative lighting apparatus and method that can provide a unique lighting effect.

SUMMARY

According to some aspects of the present disclosure, there is provided a flame simulation method including: identifying, by a computing device, a maximum brightness level value and a primary event generation level; determining, by the computing device and based on the primary event generation level, whether a first event occurred; setting, in response to determining that the first even occurred and by the computing device, a secondary event generation level; adjusting, by the computing device, the secondary event generation level towards a baseline secondary event generation level; adjusting, by the computing device, a current brightness value of a lighting element of a flame simulation apparatus towards the maximum brightness level value; determining, by the computing device and based on the secondary event generation level, whether a second event occurred; setting, in response to determining that the second event occurred and by the computing device, the current brightness level value of the lighting element to a value less than the maximum brightness level; and controlling, by the computing device, a brightness level of the lighting element to correspond to the current brightness level value of the lighting element.

The method may further include repeating, while the flame simulation apparatus is turned on, the determining whether the first event occurred, setting the secondary event generation level, adjusting the secondary event generation level, adjusting the current brightness value of the lighting element, determining whether the second event occurred, setting the current brightness level, and controlling the brightness level of the lighting element.

The repeating may be performed periodically.

Determining whether the first event occurred and determining whether the second event occurred may include determining, by the computing device, whether the events occurred using a pseudo-random event generator.

Setting the secondary event generation level may include setting the secondary event generation level to a pseudo-random value.

Setting the current brightness level value of the lighting element may include setting the current brightness level value of the lighting element to a pseudo-random value less than the maximum brightness level value.

The flame simulation device may include a plurality of lighting elements, and the method may further include performing, by the computing device and pseudo-independently for each of the plurality of lighting elements, the determining whether the first event occurred, setting the secondary event generation level, adjusting the secondary event generation level, adjusting the current brightness value of the lighting element, determining whether the second event occurred, setting the current brightness level, and controlling the brightness level of the lighting element.

The maximum brightness level value and the primary event generation level may be constant for each of the plurality of lighting elements.

The method may further include: identifying, by the computing device, a vibration level value; and controlling, by the computing device, modulation of a brightness level of the lighting element based on the vibration level value.

The controlling modulation may include controlling the brightness level of the lighting element to pseudo-randomly fluctuate within a range corresponding to the current brightness level value.

The controlling modulation may include controlling the brightness level of the lighting element to oscillate within a range corresponding to the current brightness level value.

According to some implementations, there is provided a flame simulation apparatus including: a controller; and a memory having stored thereon computer program code that, when executed by the controller, instructs the controller to: identify a maximum brightness level value and a primary event generation level; determine, based on the primary event generation level, whether a first event occurred; set, in response to determining that the first even occurred, a secondary event generation level; adjust the secondary event generation level towards a baseline secondary event generation level; adjust a current brightness value of a lighting element of a flame simulation apparatus towards the maximum brightness level value; determine, based on the secondary event generation level, whether a second event occurred; set, in response to determining that the second event occurred, the current brightness level value of the lighting element to a value less than the maximum brightness level; and control a brightness level of the lighting element to correspond to the current brightness level value of the lighting element.

The computer program code may further instruct the controller to periodically repeat the determining whether the first event occurred, setting the secondary event generation level, adjusting the secondary event generation level, adjusting the current brightness value of the lighting element, determining whether the second event occurred, setting the current brightness level, and controlling the brightness level of the lighting element.

The computer program code may instruct the controller to determine whether the first event occurred and determine whether the second event occurred using a pseudo-random event generation.

The computer program code may instruct the controller to set the secondary event generation level to a pseudo-random value.

The computer program code may instruct the controller to set the current brightness level value of the lighting element to a pseudo-random value less than the maximum brightness level value.

The apparatus may further include a plurality of lighting elements controllable by the controller. The computer program code may further instruct the controller to perform, pseudo-independently for each of the plurality of lighting elements, the determining whether the first event occurred, setting the secondary event generation level, adjusting the secondary event generation level, adjusting the current brightness value of the lighting element, determining whether the second event occurred, setting the current brightness level, and controlling the brightness level of the lighting element.

The computer program code may further instruct the controller to hold the maximum brightness level value and the primary event generation level constant for each of the plurality of lighting elements.

The computer program code may further instruct the controller to: identify a vibration level value; and control modulation of a brightness level of the lighting element based on the vibration level value.

The computer program code may instruct the controller to control modulation by controlling the brightness level of the lighting element to oscillate within a range corresponding to the current brightness level value.

BRIEF DESCRIPTION OF THE FIGURES

The accompanying drawings illustrate one or more embodiments and/or aspects of the disclosure and, together with the written description, serve to explain the principles of the disclosure. Wherever possible, the same reference numbers are used throughout the drawings to refer to the same or like elements of an embodiment, and wherein.

DETAILED DESCRIPTION

Figure 1:
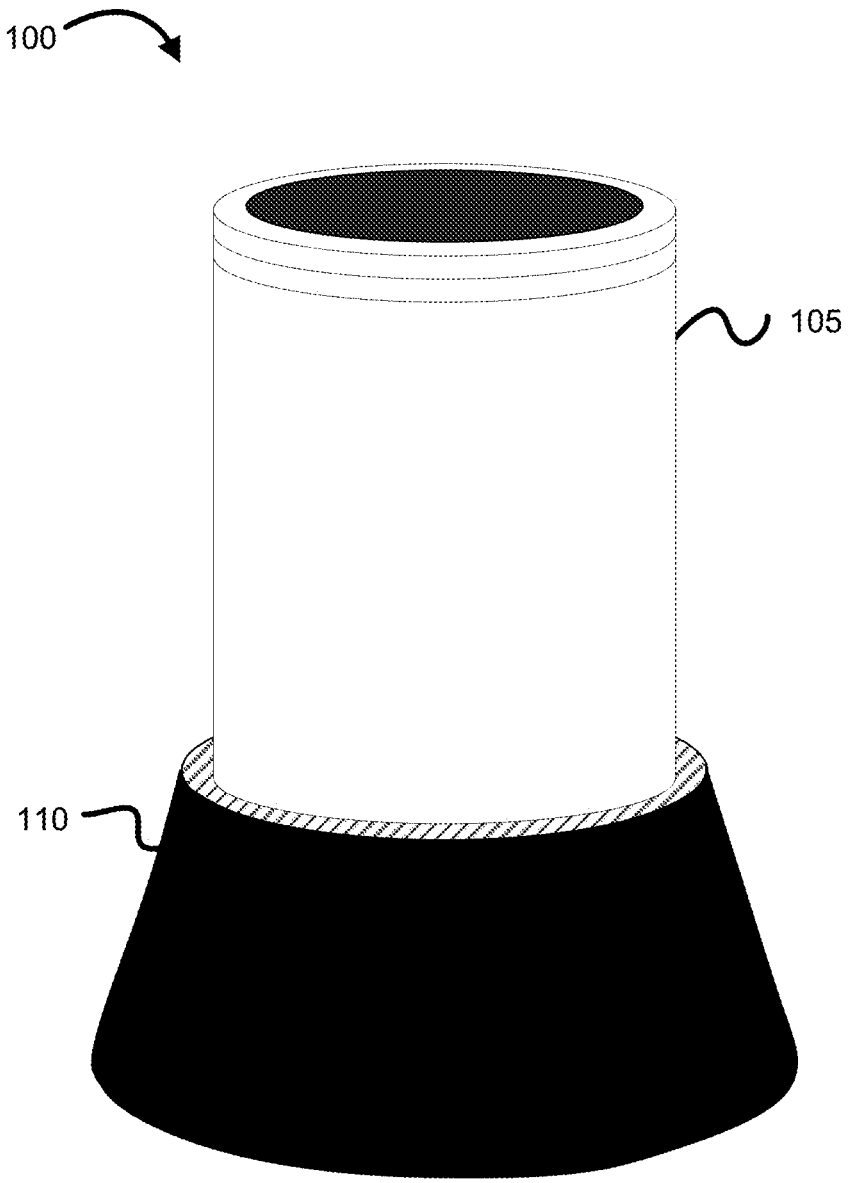
FIG. 1 is a perspective view of a flame-simulating apparatus according to an exemplary embodiment.

The present disclosure can be understood more readily by reference to the following detailed description of one or more exemplary embodiments and the examples included herein. It is to be understood that embodiments are not limited to the exemplary embodiments described within this disclosure. Numerous modifications and variations therein will be apparent to those skilled in the art and remain within the scope of the disclosure. It is also to be understood that the terminology used herein is for describing specific exemplary embodiments only and is not intended to be limiting. Some exemplary embodiments of the disclosed technology will be described more fully hereinafter with reference to the accompanying drawings. The disclosed technology might, however, be embodied in many different forms and should not be construed as limited to the exemplary embodiments set forth herein.

In the following description, numerous specific details are set forth. However, it is to be understood that embodiments of the disclosed technology may be practiced without these specific details. In other instances, well-known methods, structures, and techniques have not been shown in detail in order to avoid obscuring an understanding of this description. References to "one embodiment," "an embodiment," "example embodiment," "some embodiments," "certain embodiments," "various embodiments," etc., indicate that the exemplary embodiment(s) of the disclosed technology so described may include a particular feature, structure, or characteristic, but not that every embodiment necessarily includes the particular feature, structure, or characteristic. Further, repeated use of the phrase "in one embodiment" does not necessarily refer to the same embodiment, although it may.

Unless otherwise noted, the terms used herein are to be understood according to conventional usage by those of ordinary skill in the relevant art. In addition to any definitions of terms provided below, it is to be understood that as used in the specification and in the claims, "a" or "an" can mean one or more, depending upon the context in which it is used. Throughout the specification and the claims, the following terms take at least the meanings explicitly associated herein, unless the context clearly dictates otherwise. The term "or" is intended to mean an inclusive "or." Further, the terms "a," "an," and "the" are intended to mean one or more unless specified otherwise or clear from the context to be directed to a singular form.

Unless otherwise specified, the use of the ordinal adjectives "first," "second," "third," etc., to describe a common object, merely indicates that different instances of like objects are being referred to, and are not intended to imply that the objects so described must be in a given sequence, either temporally, spatially, in ranking, or in any other manner.

Further, in describing one or more exemplary embodiments, certain terminology will be used to for the sake of clarity. It is intended that each term contemplates its broadest meaning as understood by those skilled in the art and includes all technical equivalents that operate in a similar manner to accomplish a similar purpose.

To facilitate an understanding of the principles and features of the embodiments of the present disclosure, exemplary embodiments are explained hereinafter with reference to their implementation in illustrative embodiments. Such illustrative embodiments are not intended to be limiting.

The materials described hereinafter as making up the various elements of the embodiments of the present disclosure are intended to be illustrative only and not restrictive. Many suitable materials that would perform a same or a similar function as the materials described herein are intended to be embraced within the scope of the exemplary embodiments. Such other materials not described herein can include, but are not limited to, materials that are developed after the time of the development of the invention.

Embodiments of the disclosed technology include an artificial light source configured to generate a flickering light effect. In various embodiments, the artificial light source may include a plurality of independently controlled light sources. In various embodiments, the independently controlled light sources may be adjusted according to an event generator based on at least one of simulated wind agility, maximum flame, and flame calmness. According to some aspects, the event generator may be a random event generator. In some embodiments, a plurality of channels may control independent groupings of light sources.

Throughout this disclosure, certain exemplary embodiments are described in exemplary fashion in relation to flameless candle systems. But embodiments of the disclosed technology are not necessarily so limited. In some embodiments, the disclosed technology may be effective in other lighting systems. In some embodiments, the disclosed technology may be effective in, as non-limiting examples, stage lighting, wall or ceiling mounted lighting, flashlights, lamps.

Referring now to the drawings, FIG. 1 is a perspective view of a flame-simulating apparatus 100 according to an exemplary embodiment. According to some embodiments, the flame-simulating apparatus 100 includes a base 110 and a chimney 105. The base 110 may emit light that the chimney 105 disburses. The base 110 will be discussed in greater detail below with reference to FIGS. 2 and 3.

In some embodiments, the chimney 105 can be made of a transparent material, such as, as non-limiting examples, clear glass or plastic. In some embodiments, the chimney 105 may be made of a translucent material, such as frosted glass or translucent plastic. In some embodiments, the chimney 105 may be made of an opaque material, such as metal or silvered glass. In some embodiments, the chimney 105 may be colored and translucent.

In certain embodiments, the chimney 105 may be incorporated into the base 110. For example, in some embodiments, the chimney 105 may be detachably connected to the base 110. According to some embodiments, the flame-simulating apparatus 100 may not include a chimney 105. Further, as shown in FIG. 1, a chimney 105 can be cylindrical, though in some embodiments, the chimney 105 may take on other three-dimensional shapes such as a sphere, cuboid, triangular prism, or other shape as desired.

As illustrated in FIG. 1, in some embodiments, the flame-simulating apparatus 100 is a flameless candle 100. But it will be understood that the base 110 and chimney 105 may be applied to other flame-simulating apparatuses 100.

Figure 2:
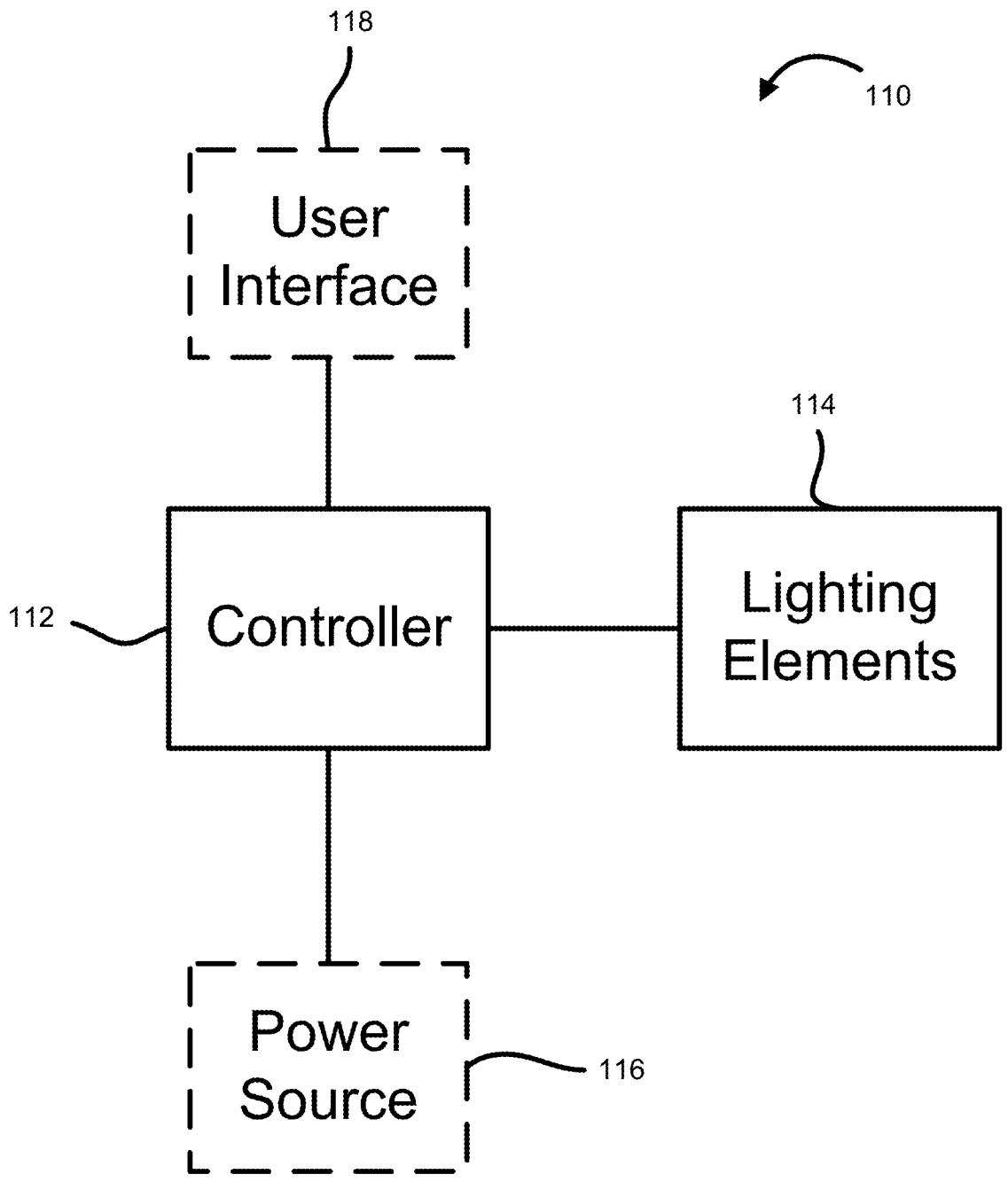
FIG. 2 is a block diagram of a base of a flameless candle according to an exemplary embodiment.

FIG. 2 is a block diagram of a base 110 of a flameless candle 100 according to an exemplary embodiment. In some embodiments, base 110 includes a controller 112, lighting elements 114, a power source 116, and a user interface 118. According to some embodiments, the controller 112 may include a storage and a processor. According to some embodiments, the controller 112 may be a microcontroller or a microprocessor. The controller 112 may be configured to control the lighting elements 114 to produce a flickering light effect. For example, the controller 112 may be configured to control the lighting elements 114 to produce a flickering light effect using a flickering method, as will be discussed below. According to some embodiments, the controller 112 may be configured to control the lighting elements 114 using a flickering algorithm based on one or more of wind agility, flame calmness, lighting baseline, and flickering speed. A more detailed description of certain exemplary embodiments of a light control method will be discussed below with reference to FIGS. 4 and 5.

According to some embodiments, the lighting elements 114 may be organized into a plurality of groups or channels. For example, in some embodiments, individual lighting elements of the lighting elements 114 may be a separate group or channel. According to some embodiments, the groups or channels of the lighting elements 114 may be separately controllable by the controller 112. Put differently, the controller 112 may independently, and in parallel, control the groups or channels of the lighting elements 114. According to some embodiments, the controller 112 may separately control the groups or channels of the lighting elements 114 to produce a flickering light effect. In some embodiments, the lighting elements 114 may be a single color (e.g., white, warm white, or yellow). In some embodiments, the lighting elements 114 may be a mix of colors.

In some embodiments, the lighting elements 114 may be a plurality of light-emitting diodes (LEDs). In some embodiments, the lighting elements 114 may be an array of LED lights. In some embodiments, the lighting elements 114 may be disposed in groups or channels on a printed circuit board (PCB).

According to some embodiments, the lighting elements 114 may be a plurality of LEDs, and the controller 112 may include one or more LED drivers. Thus, in some embodiments, the one or more LED drivers may control an intensity of the light emitted by the plurality of LEDs through pulse-width modulation of one or more currents supplied to the plurality of LEDs. According to some embodiments, the one or more LED drivers may separately control currents supplied to the different groups or channels of the plurality of LEDs through pulse-width modulation. Further, in some embodiments, the controller 112 can control a color of the plurality of LEDs through pulse-width modulation. Although the controller 112 has been described with reference to one or more LED drivers controlling a plurality of LEDs through pulse-width modulation, one of ordinary skill will recognize that, in various embodiments, alternative elements and methods may be used by the controller 112 to control the lighting elements 114.

According to some embodiments, the power source 116 may be included within the base 110. For example, the power source 116 may include one or more batteries disposed within the base 110. According to some embodiments, the power source 116 may be disposed separate from the base 110. According to some embodiments, power may be supplied from an external power source 116, such as a wall outlet. In further embodiments, power may be supplied through a hardwire connection to a power grid. As noted previously, the controller 112 may control the lighting elements 114 to produce a flickering light effect by controlling an amount of power provided to the lighting elements 114, such power being received from the power source 116.

As illustrated by FIG. 2, in some embodiments, the base 110 may include a user interface 118. The user interface 118 can provide for user control of the flameless candle 100. According to some embodiments, the user interface 118 may be used to select an on/off state of the flameless candle 100. Further, the user interface 118 may be used to select an on/off state of a flickering effect of the flameless candle 100. Additionally, the user interface 118 may be used to adjust and/or modify the flickering effect of the flameless candle 100. As non-limiting examples, the user interface 118 may be used adjust one or more of wind agility, flame calmness, lighting baseline, flickering speed, or other flickering effects.

The controller 112 may control the lighting elements 114 in accordance with a user interaction with the user interface 118.

In some embodiments, the user interface 118 may include one or more buttons disposed on a surface of the base 110. According to some embodiments, the user interface 118 may include a receiver configured to receive signals. For example, the user interface 118 may be configured to receive signals from a remote control. As non-limiting examples, the user interface 118 may be configured to receive one or more of infrared (IR) signals, radio-frequency (RF) signals, WiFi signals, Bluetooth signals, and cellular signals. According to some embodiments, the user interface 118 may be separated from the base 110. According to some embodiments, the flameless candle 100 may not include a user interface 118.

Figure 3:
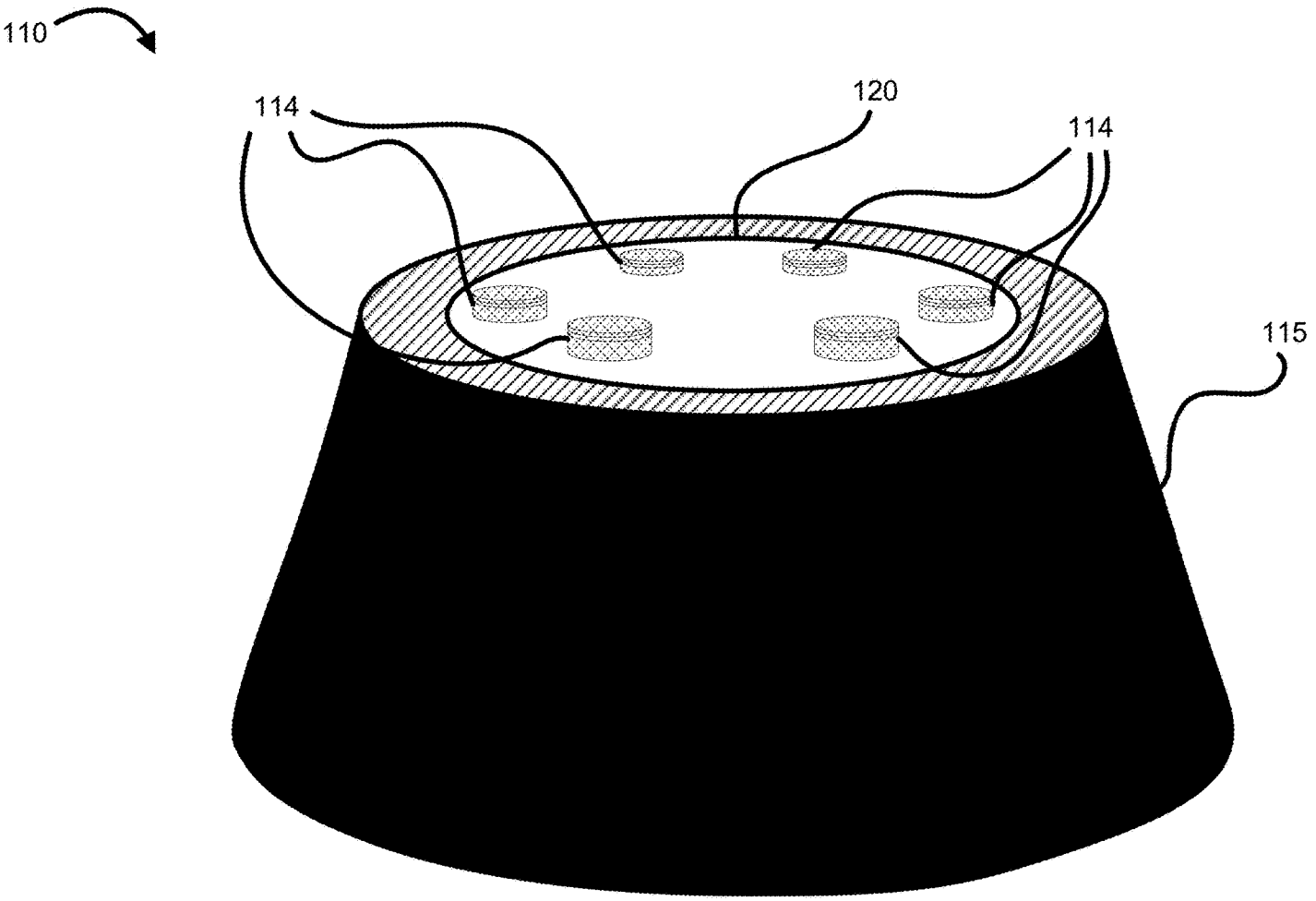
FIG. 3 is a perspective view of a base of a flameless candle according to an exemplary embodiment.

FIG. 3 is a perspective view of a base 110 of a flameless candle 100 according to some embodiments. As shown in FIG. 3, the base 110 can include a base body 115 and a base top 120, which can also be referred to as a top face of the base 110. Further, according to some embodiments, a plurality of lighting elements 114 may be disposed on the base top 120. According to some embodiments, the plurality of lighting elements 114 may be flush mounted to the base body 115 (or countersunk into the base body 115), thus creating a flat base top 120. According to some embodiments, the lighting elements 114 may be disposed on a PCB, and the PCB may be situated on top of the base top 120. According to some embodiments, the lighting elements 114 may be covered by transparent or translucent materials.

According to some embodiments, the base top 120 may include guides for the chimney 105, and the guides may assist a user in detachably affixing the chimney 105 to the base 110.

According to some embodiments, one or more of the controller 112, power source 116, and user interface 118 may be disposed within or on the base body 115.

Although the base 110 depicted in FIG. 3 includes six lighting elements 114 arranged in a substantially circular or hexagonal pattern, this is merely an exemplary arrangement of lighting elements 114. Additional exemplary arrangements are contemplated, and certain exemplary arrangements are described below with reference to FIG. 6.

Figure 4:
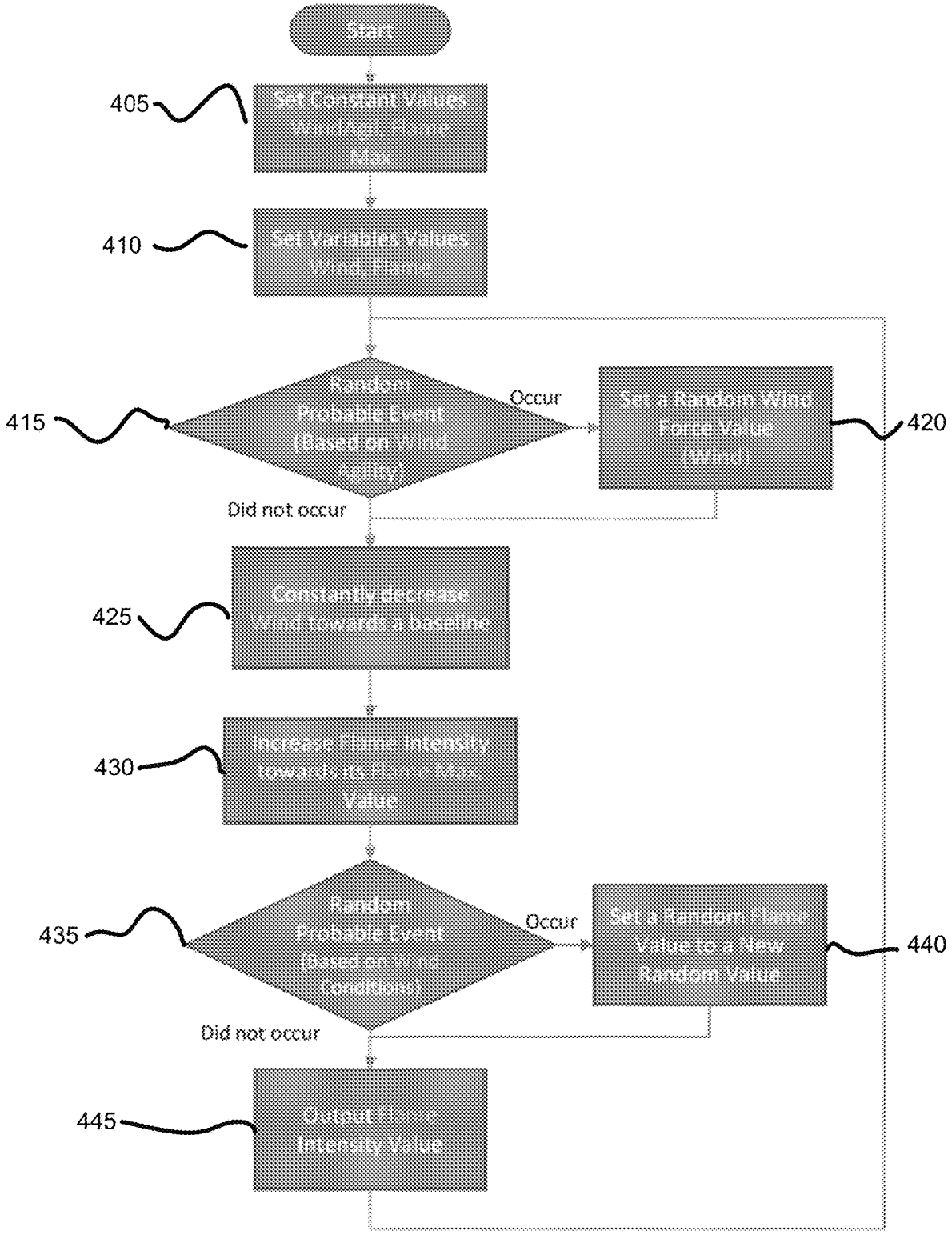
FIG. 4 illustrates a light control method according to an exemplary embodiment.

FIG. 4 illustrates a light control method according to an exemplary embodiment, which can be performed by the controller 112 to produce a flickering light effect. The light control method according to an exemplary embodiment may replicate various qualities of a traditional candle flame. For example, traditional candle flames flicker and vibrate as fuse and wax are burned. Further flickering may occur due to wind behavior, such as steady or variable base wind levels and variable wind gusts. In addition, the flame itself provides some inertial-like quality to the flickering in traditional candles. The light control method according to an exemplary embodiment may incorporate variables to replicate these various qualities of traditional flames.

As shown in FIG. 4, the method can include setting 405 constant values for wind agility and flame maximum. According to some embodiments, the values for wind agility and flame maximum may be set and adjusted according to user input. Alternatively, the controller 112 can set a default value for wind agility and flame maximum.

The method can further include setting 410 initial values for variables of WIND and FLAME. In certain implementations, a FLAME variable can represent a variation of flame intensity akin to simulating variation over time in the chemical reaction that results in flame intensity. According to some embodiments, the controller 112 may set a default WIND and FLAME values. According to some embodiments, the controller 112 may generate initial WIND and FLAME values based on the values for wind agility and flame maximum.

In some embodiments, the method can include determining 415 if a first event occurs. A probability of the first event occurring may be based on the value for wind agility. For example, the controller 112 may use a random event generator to determine if a gust of wind is observed. It will be understood that the first event occurring may correspond to a simulation of an event potentially affecting control of lighting elements 114. Further, it will be understood that, in lieu of a true random event generator, a pseudo-random event generator may be used. Additionally, in some implementations, each controller 112 in a set of controllers may determine its own value for FLAME while using a common, albeit randomly or pseudo-randomly determined, WIND value. As will be understood and appreciated, such configuration would provide variability in the FLAME among the lighting elements 114 of flameless candle 100, while each of the variable FLAME effects would be affected by the same WIND value, as would occur in real life. Alternatively, however, each controller 112 may determine values for WIND and FLAME independent of other controllers 112.

If the first event is determined to occur, the controller 112 can set 420 the WIND value. The controller may set the WIND value using a random number generator. The WIND value may also include a directional component. As discussed above, it will be understood that, in lieu of a true random number generator, a pseudo-random number generator may be used After setting the WIND value or if the first event is determined to not occur, the method can include decreasing 425 the WIND value. The controller 112 may decrease the WIND value towards a baseline. The controller 112 may decrease the WIND value at a constant rate. The controller 112 may decrease the WIND value logarithmically.

In some embodiments, the method can include increasing 430 the FLAME value. The controller 112 may increase the FLAME value toward the value for flame maximum. The controller 112 may increase the FLAME value inversely to or inversely proportional to a decrease in the WIND value. The controller 112 may increase the FLAME value correlated with the decrease in the WIND value. As will be appreciated, increasing the FLAME value inversely to a decrease in WIND value creates a natural candle flickering effect.

As shown in FIG. 4, in some embodiments, the method can include determining 435 if a second event occurs. A probability of the second event occurring may be based on the WIND value. For example, the controller 112 may use a random event generator to determine if wind interacts with a flame. It will be understood that the second event occurring corresponds to a simulation of an event affecting control of lighting elements 114. Further, as noted previously, it will be understood that, in lieu of a true random event generator, a pseudo-random event generator may be used.

If the second event is determined to occur, the method can include setting 440 a value for FLAME. The controller may set the FLAME value using a random number generator. The FLAME value may be calculated in correlation with the WIND value. It will be understood that, in lieu of a true random number generator, a pseudo-random number generator may be used to determine the FLAME value.

After setting the FLAME value or if the second event is determined to not occur, the method can include outputting 445 the FLAME value. The controller 112 may output the FLAME value by controlling the lighting elements 114. For example, if the FLAME value has increased since the previous outputted value, the controller 112 may control the light elements 114 to increase their luminance.

Figure 5:
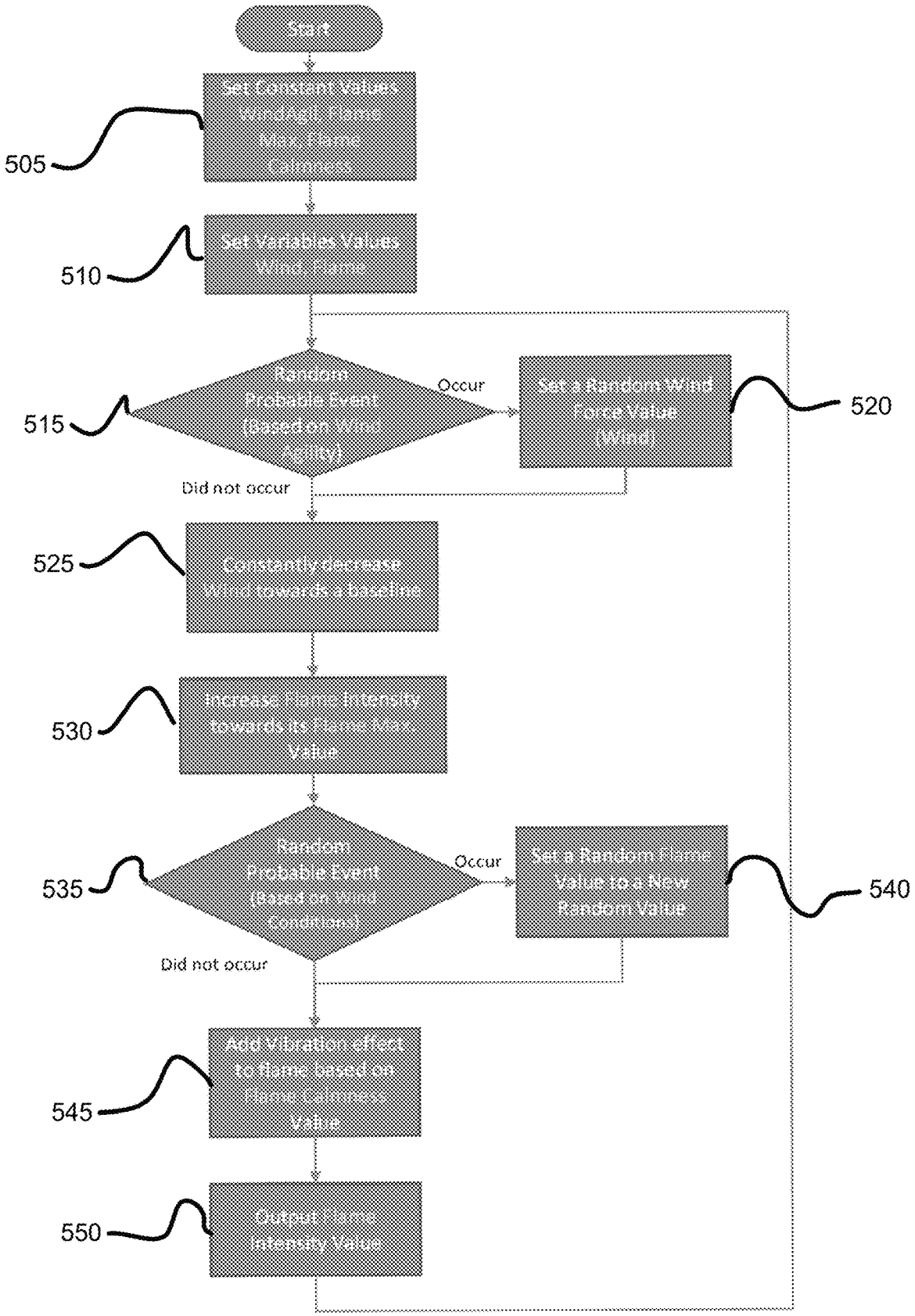
FIG. 5 illustrates a light control method according to an exemplary embodiment.

FIG. 5 illustrates a light control method according to another exemplary embodiment. According to some embodiments, the light control method may be performed by the controller 112 to produce a flickering effect. As shown in FIG. 5, the method can include setting 505 constant values for wind agility, flame maximum, and flame calmness. According to some embodiments, the values for wind agility, flame maximum, and flame calmness may be set and adjusted according to user input. According to some embodiments, the controller 112 may set a default value for wind agility, flame maximum, and flame calmness. According to some embodiments, one or more of wind agility, flame maximum, and flame calmness may be variable values instead of constant values. For example, one or more of wind agility, flame maximum, and flame calmness may vary according to a time of use, a time of day of use, or external weather information. As a non-limiting example, when first turned on, wind agility may be set to a low value, flame maximum may be set to a medium value, and flame calmness may be set to a high value. After a period of minutes, wind agility and flame maximum may be increased, while flame calmness may be decreased. As another non-limiting example, during calm weather, wind agility may be set to a low value, flame maximum may be set to a medium value, and flame calmness may be set to a high value. Meanwhile, during rougher weather, wind agility may be increased, flame maximum may be decreased, and flame calmness may be decreased. Similarly, as another non-limiting example, calmness could vary over time to simulate the chemistry and heat conditions of a candle burning down over time (i.e., melting) that would make the calmness level change.

Elements 510-540, as shown in the exemplary light control method illustrated in FIG. 5, may be substantially similar to elements 410-440 of the exemplary light control method illustrated in FIG. 4.

After setting 540 the FLAME value or if the second event is determined 535 to not occur, the method can include adding 545 a vibration effect based on the value for flame calmness. In some implementations, the vibration effect can be constant based on the value for flame calmness. According to some embodiments, the controller 112 may add the vibration effect by oscillating the FLAME value. In some implementations, oscillation can be set as a FLAME OSCILLATION constant that has a value defined at the setting 505 of the constant values. As a non-limiting example, the FLAME OSCILLATION constant can be set to 5 of a 100% maximum brightness value of a lighting element 114. Additionally, in some implementations, FLAME OSCILLATION can be independent of the FLAME value, though the two values could be proportional (e.g., the oscillation amount may be based on a current FLAME value). Additionally, flame calmness can affect FLAME OSCILLATION (i.e., more flame calmness equates to lower FLAME OSCILLATION). In some embodiments, the controller 112 may add the vibration effect by adding random or pseudo-random noise to the FLAME value. According to some embodiments, the controller 112 may calculate an amount of the vibration effect using a random-number generator. It will be understood that, in lieu of a true random number generator, a pseudo-random number generator may be used to determine an amount of the vibration effect.

As shown in FIG. 5, the method can further include outputting 550 the FLAME value. The controller 112 may output the FLAME value by controlling the lighting elements 114. For example, if the FLAME value has increased since the previous outputted value, the controller 112 may control the light elements 114 to increase their luminance. According to some embodiments, the controller 112 may cause the vibration effect by controlling the lighting elements 114 to oscillate their luminance. According to some embodiments, the controller 112 may cause the vibration effect by controlling the lighting elements 114 to adjust their luminance based on random or pseudo-random noise.

According to some embodiments, one or more elements of the light control methods described with reference to FIGS. 4 and 5 may be omitted. In some embodiments, the controller 112 can repeat the light control methods periodically. In some embodiments, the controller 112 can repeat the light control methods cyclically. In some embodiments, one or more elements of the light control methods may be omitted after a first execution. In some embodiments, the controller 112 may separately perform the light control method for each group or channel of lighting elements 114. In some embodiments, the controller 112 may separately perform the light control method for each individual lighting element of the lighting elements 114. In some embodiments, the controller 112 may separately perform the light control method for each group or channel of the lighting elements 114 with common values for wind agility, flame maximum, and flame calmness. Further, in some embodiments, the controller 112 may control a color of the lighting elements 114 in addition to controlling a luminance of the lighting elements 114. Additionally, in some embodiments, the controller 112 may continuously or near-continuously adjust the luminance of the lighting elements 114 based on changes to the FLAME value. According to some embodiments, the controller 112 may adjust the luminance of the lighting elements 114 only based on the FLAME value output in 445 or 550. Further, the controller 112 may continuously adjust the luminance of the lighting elements 114 based on the vibration effect.

Figure 6:
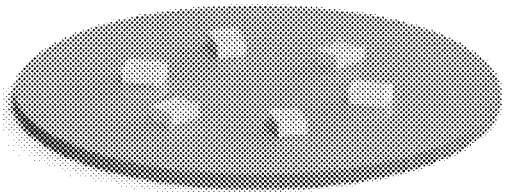
FIG. 6 illustrates exemplary arrangements of lighting elements.
Figure 6:
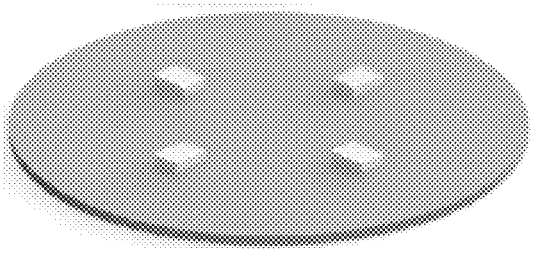
Figure 6:
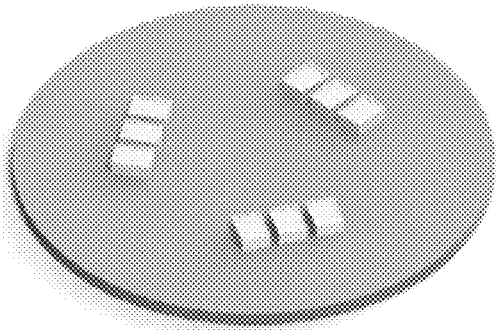
Figure 6:
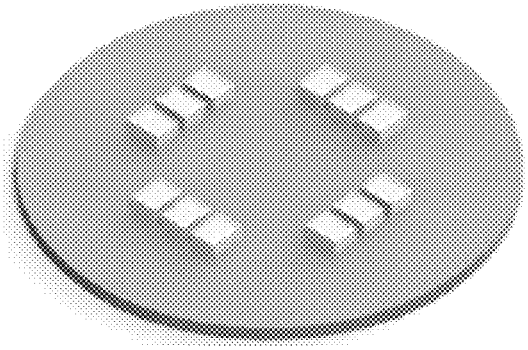
Figure 6:
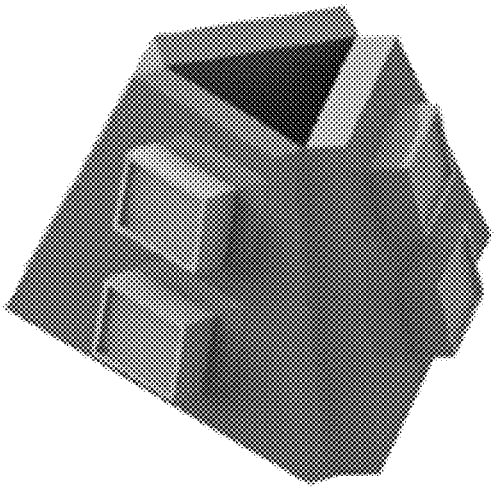
Figure 6:
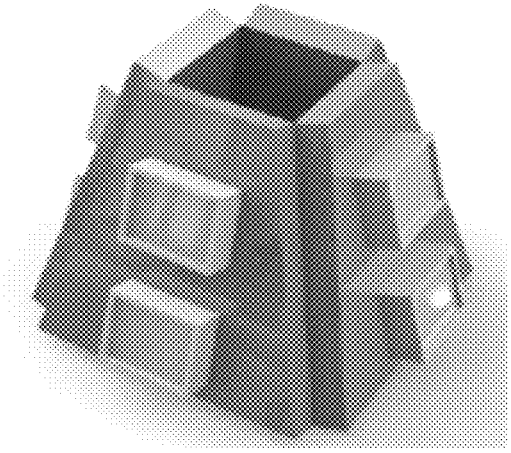

FIG. 6 illustrates exemplary arrangements of lighting elements. As shown in FIG. 6, the lighting elements 114 can be arranged as six lighting elements 114 in a circular pattern 600(*a*), four lighting elements 114 in a circular pattern 600(*b*), three groups of three lighting elements 114 in a triangular pattern 600(*c*), four groups of three lighting elements 114 in a square pattern 600(*d*), three groups of two lighting elements 114 in a three-sided pyramid 600(*e*), or four groups of two lighting elements 114 in a four-sided pyramid 600(*f*). As noted, according to some embodiments, each group of lighting elements 114 can be separately controllable. According to some embodiments, each lighting element of lighting elements 114 may be separately controllable. It will be understood that the arrangements of lighting elements 114 shown in FIG. 6 are for illustrative purposes only, and the lighting elements 114 as used in a flame-simulating apparatus 100 is not be limited thereto.

Figure 7:
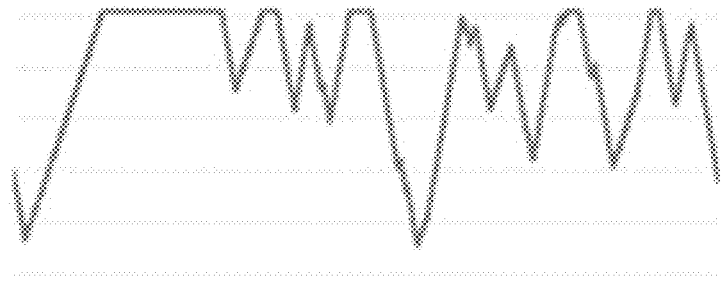
FIG. 7 illustrates outputs of lighting elements according to an exemplary embodiment.
Figure 7:
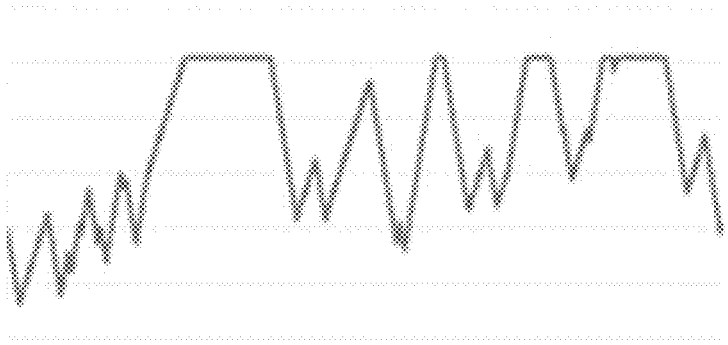
Figure 7:
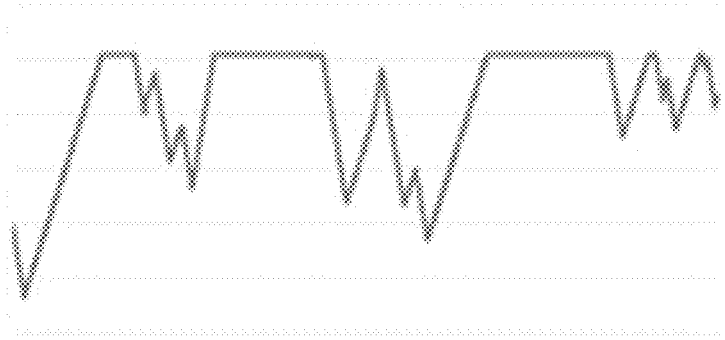
Figure 7:
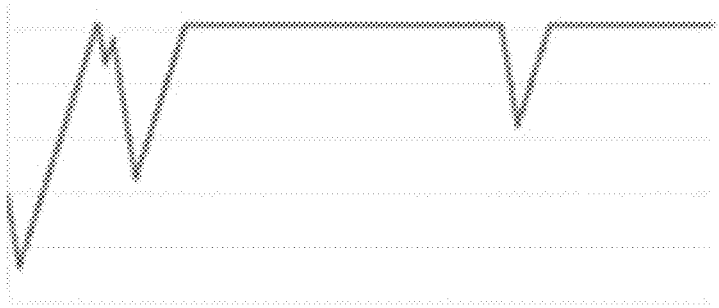

FIG. 7 illustrates outputs of a lighting element under control of a light control method according to an exemplary embodiment. For example, FIG. 7 illustrates changes to an intensity value over time according to different wind agility values. 700(*a*) illustrates changes to the intensity value over time with a high wind agility value (e.g., 76-100 on a scale from 1 to 100). 700(*b*) illustrates changes to the intensity value over time with a medium-high wind agility value (e.g., 51-75 on a scale from 1 to 100). 700(*c*) illustrates changes to the intensity value over time with a medium-low wind agility value (e.g., 26-50 on a scale from 1 to 100). 700(*d*) illustrates changes to the intensity value over time with a low wind agility value (e.g., 1-25 on a scale from 1 to 100). It will be understood that the output responses over time illustrated in FIG. 7 are merely exemplary, and different output responses may be generated from same or similar wind agility values.

Figure 8:
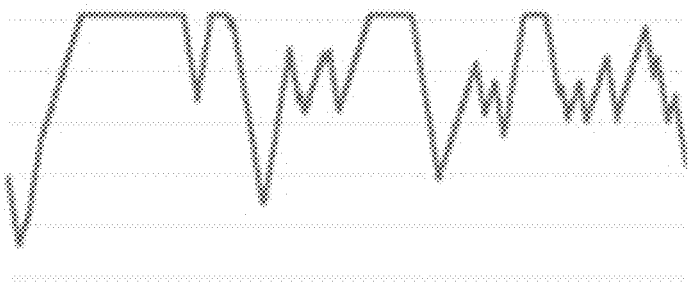
FIG. 8 illustrates outputs of lighting elements according to an exemplary embodiment.
Figure 8:
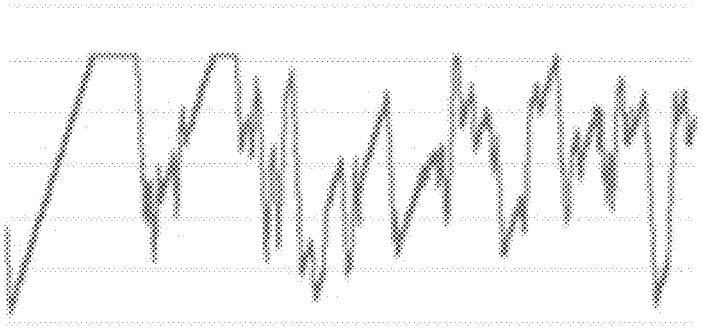
Figure 8:
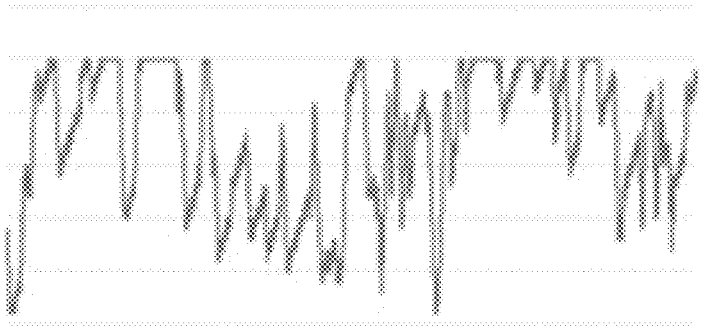
Figure 8:
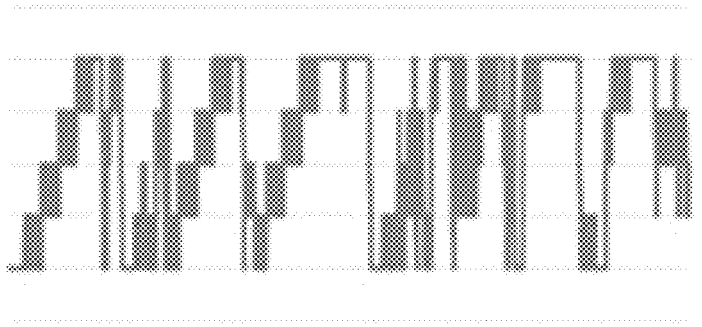

FIG. 8 illustrates outputs of a lighting element under control of a light control method according to an exemplary embodiment. For example, FIG. 8 illustrates changes to an intensity value over time according to different flame calmness values. 800(*a*) illustrates changes to the intensity value over time with a high flame calmness value (e.g., 76-100 on a scale from 1 to 100). 800(*b*) illustrates changes to the intensity value over time with a medium-high wind flame calmness (e.g., 51-75 on a scale from 1 to 100). 800(*c*) illustrates changes to the intensity value over time with a medium-low flame calmness value (e.g., 26-50 on a scale from 1 to 100). 800(*d*) illustrates changes to the intensity value over time with a low flame calmness value (e.g., 1-25 on a scale from 1 to 100). It will be understood that the output responses over time illustrated in FIG. 8 are merely exemplary, and different output responses may be generated from same or similar wind agility values.

One or more of the constants and variables described herein may be stored in various configurations. For example, in some instances, one or more of the constants or variables may be stored as integers on a scale, for example, from 1 to 100. In some instances, one or more of the constants or variables may be stored as decimals or fractions on a scale, for example, from 1 to 10. In some instances, one or more of the constants or variables may be stored as a percentage or decimal between 0 and 1. It will be understood that these are merely exemplary, and the constants or variables may be stored or output in a plurality of manners.

Figure 9:
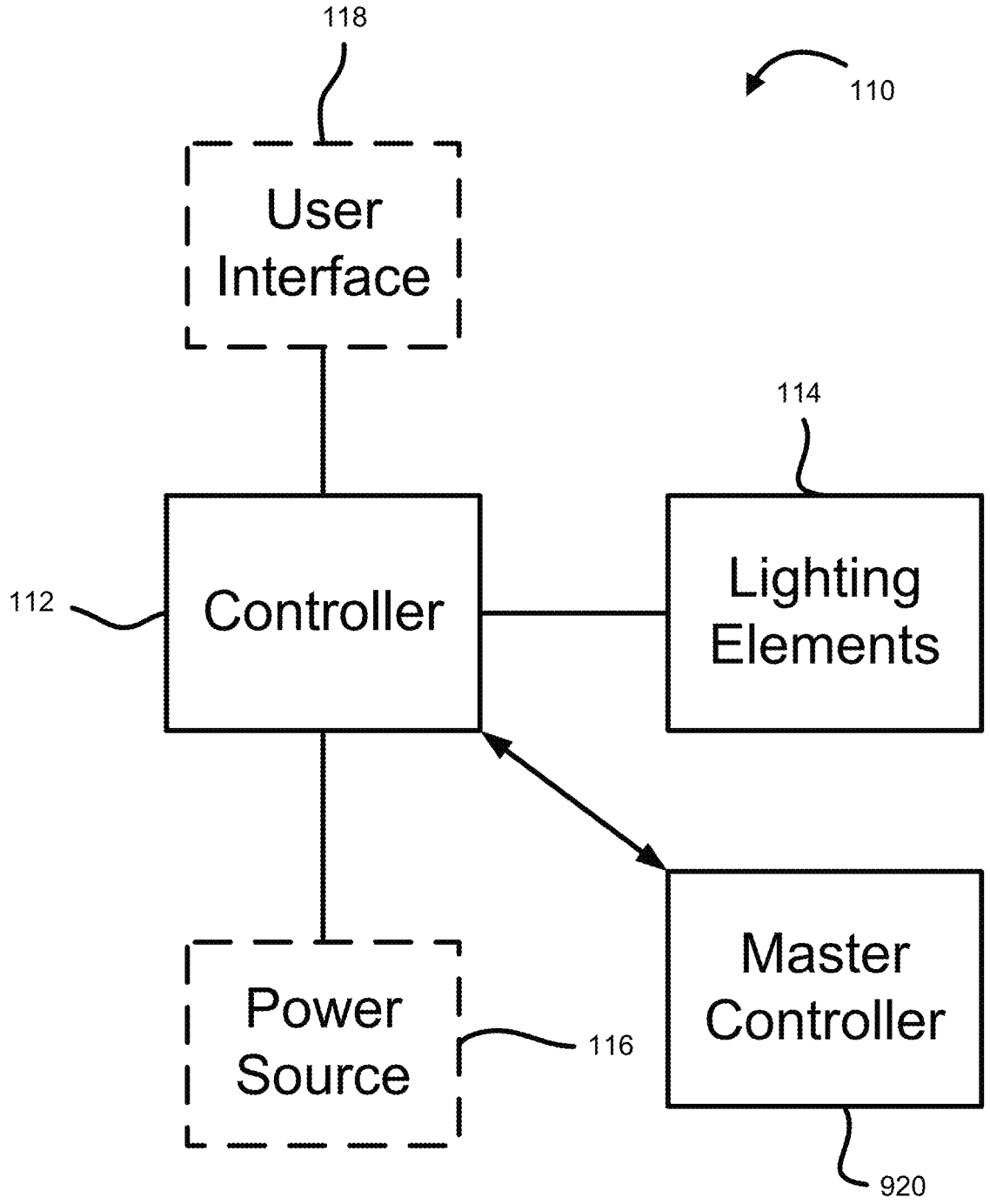
FIG. 9 is a block diagram of a base of a flameless candle according to an exemplary embodiment.

FIG. 9 is a block diagram of a base 110 of a flameless candle 100 according to an example embodiment. In some embodiments, base 110 includes a controller 112, lighting elements 114, a power source 116, a user interface 118, and a master controller 920. The controller 112, lighting elements 114, power source 116, and user interface 118 may be substantially similar to those elements as described above with reference to FIG. 2. The master controller 920 command a specific setup of the flameless candle 100. For example, the master controller 920 may command a specific illumination level or flickering mode of the flameless candle 100. In some implementations, the master controller 920 may be in communication with one or more controllers 112 of the flameless candle 100. In some cases, the master controller 920 may send instructions to the controller 112 to implement specific setups. Alternatively, in some implementations, the master controller 920 may be implemented within the controller 112 (e.g., as software, hardware, or a combination of software and hardware).

In some cases, the master controller 920 may be external to the base 110 of the flameless candle 100. In some implementations, the master controller may be external to the flameless candle 110. In some cases, the controller 112 may be further configured to receive commands from an external master controller 920. For example, the master controller 920 may be implemented in a charging station, and may communicate with the controller 112 while the flameless candle 100 is charging. In some cases, the master controller 920 may be configured to communicate wirelessly with the controller 112 to control the flameless candle 100. In such cases, the master controller 920 may communicate with the controller 112 through the user interface 118 or the controller 112 may include a wireless receiver. In some cases, the master controller 920 may communicate with a plurality of flameless candles 100 (e.g., controllers 112 of different flameless candles 100) simultaneously or substantially simultaneously. Accordingly, the plurality of flameless candles 100 may be commanded to a particular setup simultaneously using the master controller 920.

This written description uses examples to disclose certain embodiments of the disclosed technology, including the best mode, and also to enable any person skilled in the art to practice certain embodiments of the disclosed technology, including making and using any devices or systems and performing any incorporated methods. The patentable scope of certain embodiments of the disclosed technology is defined in the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A method for simulating a candle flame, the method comprising:

setting, by a computing device, initial values for each of a plurality of flame qualities;

initially setting, by the computing device, current values for a first flame characteristic and a second flame characteristic;

responsive to determining, by the computing device, an occurrence of a first event, setting the current value of the first flame characteristic to an updated value;

until a second event is determined to have occurred, iteratively, by the computing device, (i) reducing and resetting the current value of the first flame characteristic toward a baseline first flame characteristic value, (ii) increasing and resetting the current value of the second flame characteristic toward a maximum second flame characteristic value, and (iii) outputting a signal for controlling a lighting element according to the current value of the second flame characteristic; and responsive to determining, by the computing device, an occurrence of a second event (i) generating an updated second flame characteristic value, (ii) resetting the current value of the second flame characteristic to the updated second flame characteristic value, and (iii) outputting a signal for controlling the lighting element according to the current value of the second flame characteristic.

2. The method of claim 1, wherein each initial value for each respective flame quality is a variable value.

3. The method of claim 1, wherein the plurality of flame qualities comprises at least two of a group consistent of wind agility, flame maximum, and flame calmness.

4. The method of claim 3, wherein an initial wind agility value and an initial flame maximum value are each default values and an initial flame calmness value is a variable value.

5. The method of claim 3, wherein an initial wind agility value is lower than an initial flame maximum value, and the initial flame maximum value is lower than an initial flame calmness value.

6. The method of claim 3, wherein an initial wind agility value is higher than an initial flame maximum value, and the initial flame maximum value is higher than an initial flame calmness value.

7. The method of claim 3, where a probability of the occurrence of the first event is based at least in part on an initial wind agility value.

8. The method of claim 3, initially setting the current values for the first flame characteristic and the second flame characteristic comprises setting the current value for the first flame characteristic based on an initial wind agility value and setting the current value for the second flame characteristic based on an initial flame maximum value.

9. The method of claim 1, wherein initially setting the current values for the first flame characteristic and the second flame characteristic comprises setting the current value for the first flame characteristic and setting the current value for the second flame characteristic to respective default values.

10. The method of claim 1, wherein the first flame characteristic is representative of simulated wind and the second flame characteristic is representative of luminance.

11. The method of claim 1, wherein the reducing the current value of the first flame characteristic toward the baseline first flame characteristic value and the increasing the current value of the second flame characteristic toward a maximum second flame characteristic value are logarithmic.

12. The method of claim 1, where a probability of the occurrence of the second event is based at least in part on the current value of the first flame characteristic.

13. A method for simulating a candle flame, the method comprising:

setting, by a computing device, (i) initial values for each of a plurality of flame qualities and (ii) a current value for a first flame characteristic;

initially setting, by a first computing device associated with a first lighting element, a current value for a second flame characteristic associated with the first lighting element;

initially setting, by a second computing device associated with a second lighting element, a current value for a second flame characteristic associated with the second lighting element;

responsive to determining, by the computing device, an occurrence of a first event, setting the current value of the first flame characteristic to an updated value;

until a second event is determined to have occurred:

iteratively, by the computing device, reducing and resetting the current value of the first flame characteristic toward a baseline first flame characteristic value;

iteratively, by the first computing device associated with the first lighting element, (i) increasing and resetting the current value of the second flame characteristic associated with the first lighting element toward a maximum second flame characteristic associated with the first lighting element, and (ii) outputting a signal for controlling the first lighting element according to the current value of the second flame characteristic associated with the first lighting element; and iteratively, by the second computing device associated with the second lighting element, (i) increasing and resetting the current value of the second flame characteristic associated with the second lighting element toward a maximum second flame characteristic associated with the second lighting element value, and (ii) outputting a signal for controlling the second lighting element according to the current value of the second flame characteristic associated with the second lighting element responsive to determining, by the computing device, an occurrence of a second event, outputting a signal representing a confirmation of the occurrence of the second event to (i) the first computing device associated with the first lighting element and (ii) the second computing device associated with the second lighting element;

responsive to receipt, by the first computing device associated with the first lighting element and from the computing device, of the signal representing the confirmation of the occurrence of the second event, (i) generating an updated second flame characteristic value associated with the first lighting element, (ii) resetting the current value of the second flame characteristic associated with the first lighting element to the updated second flame characteristic value associated with the first lighting element, and (iii) outputting a signal for controlling the first lighting element according to the current value of the second flame characteristic associated with the first lighting element; and responsive to receipt, by the second computing device associated with the second lighting element and from the computing device, of the signal representing the confirmation of the occurrence of the second event, (i) generating an updated second flame characteristic value associated with the second lighting element, (ii) resetting the current value of the second flame characteristic associated with the second lighting element to the updated second flame characteristic value associated with the second lighting element, and (iii) outputting a signal for controlling the second lighting element according to the current value of the second flame characteristic associated with the second lighting element.

14. The method of claim 13, wherein each initial value for each respective flame quality is a variable value.

15. The method of claim 13, wherein the plurality of flame qualities comprises at least two of a group consistent of wind agility, flame maximum, and flame calmness.

16. The method of claim 15, wherein an initial wind agility value and an initial flame maximum value are each default values and an initial flame calmness value is a variable value.

17. The method of claim 15, wherein an initial wind agility value is lower than an initial flame maximum value, and the initial flame maximum value is lower than an initial flame calmness value.

18. The method of claim 15, wherein an initial wind agility value is higher than an initial flame maximum value, and the initial flame maximum value is higher than an initial flame calmness value.

19. The method of claim 13, wherein (i) the reducing the current value of the first flame characteristic toward the baseline first flame characteristic value, (ii) the increasing the current value of the second flame characteristic associated with the first lighting element toward a maximum second flame characteristic associated with the first lighting element, and (iii) the increasing the current value of the second flame characteristic associated with the second lighting element toward a maximum second flame characteristic associated with the second lighting element are logarithmic.

* * * * *